United States Patent [19]

Murzsa

[11] Patent Number: 4,926,390

[45] Date of Patent: May 15, 1990

[54] PAINT MIXING CONTAINER

[76] Inventor: Laszlo Murzsa, 4279 Lakeshore Road, Kelowna, British Columbia, Canada, V1W 1W2

[21] Appl. No.: 216,776

[22] Filed: Jul. 8, 1988

[30] Foreign Application Priority Data

Jul. 8, 1987 [CA] Canada ..... 541633

[51] Int. Cl.[5] ..... B01F 7/24; B65D 47/14

[52] U.S. Cl. ..... 366/249; 366/282; 366/312; 366/320; 366/347; 366/605; 222/570; 220/334; 220/298

[58] Field of Search ..... 366/279, 280, 281, 282, 366/283, 284, 285, 130, 129, 310, 311, 347, 318, 320, 309, 312, 242-254, 605; 220/470, 334, 297-300, 85 CH; 222/470, 570, 517

[56] References Cited

U.S. PATENT DOCUMENTS

| | | | |
|---|---|---|---|
| 268,245 | 11/1882 | Lahrmann | 366/244 |
| 411,870 | 10/1889 | Mulford | 366/252 |
| 413,546 | 10/1889 | Pearl | 220/334 |
| 680,229 | 8/1901 | Davis | 366/248 |
| 871,988 | 11/1907 | Fay | 366/281 |
| 912,842 | 2/1909 | Griffiths | 366/281 |
| 1,344,836 | 6/1920 | Walden | 366/130 |
| 3,027,044 | 3/1962 | Winstead | 220/490 |
| 3,041,052 | 6/1962 | Dedoes | 366/247 |
| 3,606,102 | 9/1971 | Lowry et al. | 222/570 |
| 3,820,692 | 6/1974 | Swett et al. | 366/347 |
| 4,010,934 | 3/1977 | McCord | 366/130 |
| 4,050,678 | 9/1977 | Smith | 366/130 |
| 4,155,656 | 5/1979 | Kramer | 366/347 |
| 4,407,584 | 10/1983 | Bouldin et al. | 366/279 |
| 4,422,770 | 12/1983 | Geible | 366/279 |
| 4,472,063 | 9/1984 | Eickelmann | 366/310 |

*Primary Examiner*—Harvey C. Hornsby
*Assistant Examiner*—Joseph S. Machuga
*Attorney, Agent, or Firm*—Renner, Kenner, Grieve, Bobak, Taylor & Weber

[57] ABSTRACT

A paint mixing container comprising a main body (2) of circular cross section with a base (4), side walls and an open top (6). There is a stirring arm (40) comprising a rotatable central shaft (42) with a helical blade (43) rigidly mounted about the central shaft. As well, there is a removable cover (20) with locking means (12,52) to allow the cover to be attached to the main body. The removable cover has a sealable opening (22) and means (24) to rotatably support the stirring arm in the interior of the main body.

10 Claims, 1 Drawing Sheet

PAINT MIXING CONTAINER

TECHNICAL FIELD

This invention relates generally to a paint mixing container and more specifically to a container for mixing automotive paints prior to application.

BACKGROUND ART

Presently, when paint is required, automotive body repair shops use paint mixing systems that require mixing base coat paints in one gallon containers designed for use on a power driven mixing machine. The base paints are in turn mixed in a separate container to create the final desired colour. Thinners and hardeners are added and mixed by hand since it is important that these additives and the paint be thoroughly mixed in order to obtain a good final finish. Each of the mixing containers used must now be thoroughly cleaned using strong industrial chemicals.

DISCLOSURE OF THE INVENTION

The present invention is a paint mixing container comprising:

- a main body of circular cross-section with a base, side walls and an open top;
- a stirring arm comprising a rotatable central shaft with a helical blade rigidly mounted about said central shaft;
- a removable cover for covering the open top of said main body with a sealable opening and means to rotatably support said stirring arm in the interior of the main body; and
- locking means to allow said removable cover to be removable attached to the open top of said main body.

In a preferred embodiment of the present invention the main body has a capacity of 6.7 liters allowing all the ingredients necessary for preparing a coat of paint to be mixed in a single container. As well, in the preferred embodiment of the present invention, the main body is fitted with a disposable plastic liner which can be discarded after the paint has been mixed thereby saving clean-up time and avoiding the use of potentially harmful cleaning chemicals. The stirring arm of the present invention avoids the present practice of manually stirring the paint and additive mixture and uses a helical blade rotated by a powered mixer to thoroughly and consistently stir and blend the paint. The sealable opening in the cover of the present invention allows easy pouring of the main body contents or the addition of ingredients to the main body. As well, the sealable opening provides a point of attachment for a spray gun assembly so the final paint preparation can be applied directly from the mixing container thereby minimizing paint spillage.

BRIEF DESCRIPTION OF THE DRAWINGS

The present invention is illustrated, merely by way of example, in the drawings in which.

PREFERRED EMBODIMENT FOR CARRYING OUT THE INVENTION

Figure 2:
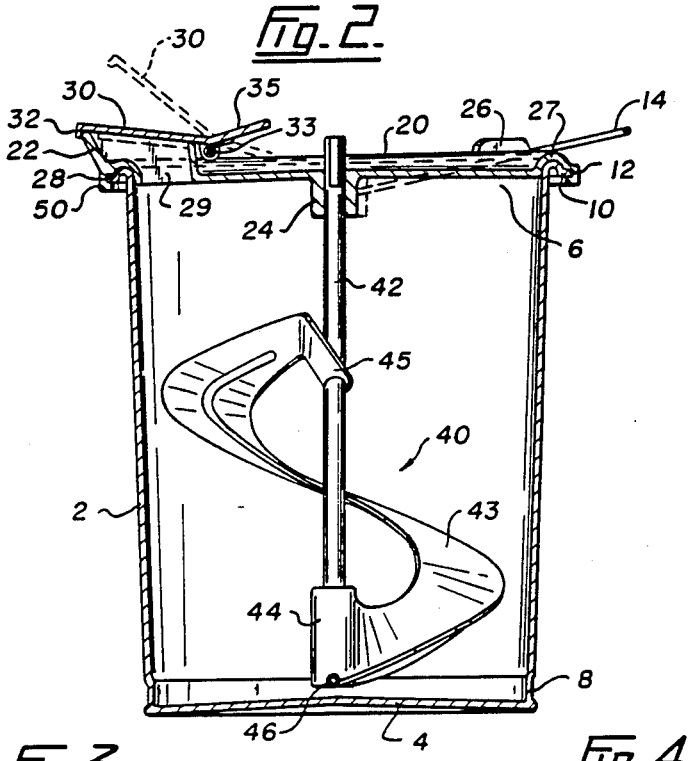
FIG. 2 is a section view of a preferred embodiment of the present invention showing the stirring blade.

A preferred embodiment of the present invention is best shown in FIG. 2 and comprises main body 2, removable cover 20 and stirring arm 40.

Figure 3:
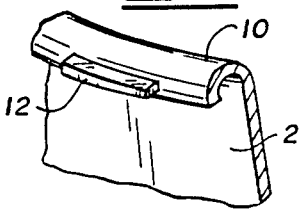
FIG. 3 is a view of the wedge locking tabs on the main body.

Main body 2 is a cylindrical container with a sealed base 4 and an open top 6. Base 4 is shaped as a flattened cone so that the base slopes downwardly from the centre at a two degree angle to the outer edges of the main body. Also toward the base of main body 2 is circumferential notch 8 to allow the main body to be easily secured to a powered mixer platform. At open top 6, the wall of main body 2 is shaped to form lip 10. Wire handle 14 is mounted to main body 2 by mounting tabs 15 that extend downwardly from lip 10. At spaced intervals around the lower edge of lip 10 are wedge shaped tabs 12 projecting outwardly from the lip at shown in FIG. 3. These tabs 12 are part of the locking system which allows removable cover 20 to be sealed atop main body 2.

Figure 1:
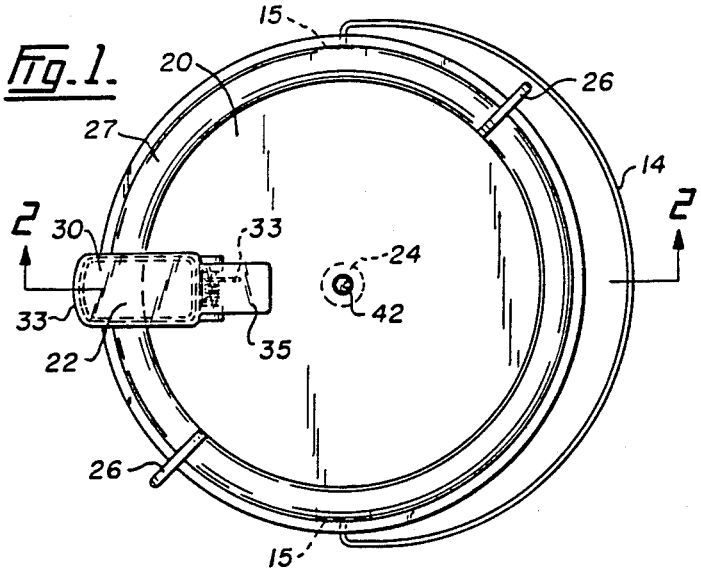
FIG. 1 is a plan view of a preferred embodiment of the present invention.
Figure 4:
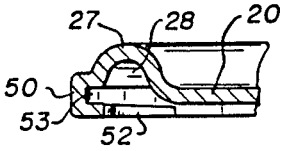
FIG. 4 is a view of the wedge locking tabs on the cover.

Removable cover 20 is best shown in FIG. 1 with sealable spout 22 at one edge of the cover and stirring arm support housing 24 mounted on the underside at the centre of the cover. The circumference of cover 20 is bounded by raised lip 27 with internal channel 28 having a semi-circular cross section shaped to fit over lip 10 of the main body. As is best shown in FIG. 4, raised lip 27 is shaped into a right angled lip 50 just below internal channel 28. Right angled lip 50 has a series of wedge tabs 52 spaced about the lower internal edge of the lip creating tapered channels 53 above each tab. Wedge tabs 52 are tapered in the opposite direction to wedge tabs 12 to main body 2. Handles 26 are used to rotate removable cover 20 after the cover has been placed atop main body 2. Rotating cover 20 causes wedge tabs 12 of main body 2 to engage wedge tabs 52 of the cover causing tabs 12 to become wedged in channels 53 of the cover thereby sealing the cover into place on the main body.

Sealable spout 22 is formed by walls extending upwardly around aperture 29 in cover 20. Angled flap 30 is pivotally connected to the top of cover 20 and serves to seal spout 22 as angled flap 30 is formed with an outer lip 32 which fits tightly about the walls of spout 22. Biasing spring 33 ensure that angled flap 30 is normally in the closed positioned as shown in FIG. 2. To open spout 22, pressure is applied to surface 35 of angled flap 30 to pivot the flap into the raised position shown by dashed lines in FIG. 2.

Stirring arm support housing 24 is molded to the underside of cover 20 to rotatably support shaft 42 of stirring arm 40. Shaft 42 extends from the interior of main body 2 through cover 20. The upper end of shaft 42 is keyed as shown in FIG. 2 to allow the shaft to be connected to a powered mixer. Helical blade 43 is mounted about shaft 42 and spans the diameter of the main body with adequate clearance of the side walls to allow the blade to freely rotate. Helical blade 43 is made from flexible plastic and is attached to shaft 42 by lower mounting bracket 44 fitted over the lower end of shaft 42 and by upper bracket 45. Lower mounting bracket 44 also supports wire stirrers 46 that extend essentially radially to shaft 42 at a slight downward angle of two degrees to match the slope of base 4. These stirrers are necessary to keep the lowest layer of fluid in the main body circulating so that it does not stagnate.

Before using the present invention, one can insert a formed plastic liner (not shown) corresponding to the internal shape of the main body 2. This liner extends above the upper edge of the main body and is folded over lip 10 before cover 20 is rotated in place to seal the main body. The plastic liner prevents the inner surface of the main body from coming into contact with the contents inside the plastic liner. Thus, the clean-up procedure necessary with the present invention is greatly simplified since all that is necessary is for the plastic liner to be removed from the main body and discarded.

The embodiments of the invention in which an exclusive property or privilege is claimed are defined as follows:

1. A paint mixing container comprising:

a main body of circular cross-section with a base, side walls and an open top;

a stirring arm comprising a rotatable central shaft with a helical blade rigidly mounted about said central shaft;

a removable cover for covering the open top of said main body having a sealable opening and means to rotatably support said stirring arm in the interior of the main body wherein said sealable opening is an essentially rectangular hole in said removable cover, the perimeter of said rectangular hole being enclosed by a raised rim with an angled rim wall forming a spout, said sealable opening having a pivotally mounted flap shaped to correspond to the opening, said flap having an outer lip to tightly surround the raised rim to said opening when the flap is in a closed position in order to seal the opening; and locking means to allow said removable cover to be removably attached to the open top of said main body;

said locking means comprising a first set of spaced wedge tabs about the upper edge of said open top of said main body and second set of spaced wedge tabs about the edge of said removable cover, said first and second sets of wedge tabs being tapered in opposite directions whereby rotating said removable cover when placed atop the open end of said main body causes said first and second set of wedge tabs to lock together thereby sealing the cover onto the main body.

2. A paint mixing container as claimed in claim 1 in which the base of said main body is a cone with an apex at the centre of the base and sides sloping downwardly to join with the side walls of the main body, the sloping sides of the base cone forming an angle of two degrees to the horizontal.

3. A paint mixing container as claimed in claim 1 in which the main body is made from plastic.

4. A paint mixing container as claimed in claim 1 in which said helical blade is attached to the base of said central shaft by a lower mounting member mounted about said central shaft, said helical blade extending upwardly and outwardly from said lower mounting member to smoothly connect said helical blade to said lower mounting member, said helical blade extending upwardly about said central shaft for one complete revolution of the shaft, the upper end of said helical blade being attached to said central shaft by an upper mounting member extending toward and encircling said central shaft.

5. A paint mixing container as claimed in claim 4 in which said lower mounting member for said helical blade is a tubular boss which fits about the base of said central shaft.

6. A paint mixing container as claimed in claim 4 in which said lower mounting member for said helical blade includes wire members extending radially to the axis of said central shaft in order to ensure proper mixing of materials at the bottom of the main body.

7. A paint mixing container as claimed in claim 4 in which said helical blade is made from flexible plastic.

8. A paint mixing container as claimed in claim 1 in which said means to support said stirring arm is a tubular shaft support mounted to said cover and adapted to rotatably hold the upper portion of the central shaft of said stirring arm so that the central shaft extends through the cover and into the interior of the main body where the helical blade is attached for stirring the contents held in the main body.

9. A paint mixing container as claimed in claim 1 in which said pivotably mounted flap is biased by a spring into the closed position.

10. A paint mixing container as claimed in claim 1 in which said main body is equipped with a wire handle.

* * * * *